US008523003B2

(12) United States Patent
Kunieda

(10) Patent No.: US 8,523,003 B2
(45) Date of Patent: Sep. 3, 2013

(54) RESIN CONTAINER

(71) Applicant: Kodama Plastics Co., Ltd., Gifu (JP)

(72) Inventor: Shin-ichi Kunieda, Gifu (JP)

(73) Assignee: Kodama Plastics Co., Ltd., Gifu-Ken (JP)

( * ) Notice: Subject to any disclaimer, the term of this patent is extended or adjusted under 35 U.S.C. 154(b) by 0 days.

(21) Appl. No.: 13/647,489

(22) Filed: Oct. 9, 2012

(65) Prior Publication Data

US 2013/0105498 A1 May 2, 2013

(30) Foreign Application Priority Data

Oct. 27, 2011 (JP) ..... 2011-235555

(51) Int. Cl.
*B65D 6/40* (2006.01)

(52) U.S. Cl.
USPC ..... 220/601; 220/4.05

(58) Field of Classification Search
USPC ..... 220/601, 623, 4.13, 4.12, 608, 571, 220/DIG. 6, DIG. 7, DIG. 1, 709, 705, 600, 220/4.05, 4.04; 141/25, 374; 222/382, 372
IPC ..... B65D 6/40
See application file for complete search history.

(56) References Cited

U.S. PATENT DOCUMENTS

| | | | | | |
|---|---|---|---|---|---|
| 70,414 | A | * | 11/1867 | Cook | 217/3 CB |
| 1,430,000 | A | * | 9/1922 | Bell | 220/623 |
| 1,619,492 | A | * | 3/1927 | Spaeth | 277/622 |
| 1,725,775 | A | * | 8/1929 | Badger | 169/86 |
| 1,767,680 | A | * | 6/1930 | Hutt | 222/146.4 |
| 2,087,349 | A | * | 7/1937 | Lucker | 220/4.04 |
| 2,105,487 | A | * | 1/1938 | Lozon | 141/17 |
| 2,405,998 | A | * | 8/1946 | Buttner et al. | 62/50.2 |
| 2,657,826 | A | * | 11/1953 | Ludowitz | 220/610 |
| 2,703,138 | A | * | 3/1955 | Amon, Jr. | 137/209 |
| 2,912,018 | A | * | 11/1959 | Leech | 141/18 |
| 3,129,730 | A | * | 4/1964 | Simon | 141/286 |
| 3,370,737 | A | * | 2/1968 | Ainslie | 220/4.05 |
| 4,666,062 | A | * | 5/1987 | Pershall | 222/82 |
| 4,828,131 | A | * | 5/1989 | Strubel | 222/464.7 |
| 5,002,195 | A | * | 3/1991 | Lasson | 220/4.12 |
| 5,071,028 | A | * | 12/1991 | Murphy | 220/601 |
| 5,597,085 | A | * | 1/1997 | Rauworth et al. | 220/581 |
| 6,047,846 | A | * | 4/2000 | Watson | 220/601 |
| 6,223,930 | B1 | * | 5/2001 | Watson | 220/601 |
| 2006/0237089 | A1 | * | 10/2006 | Alex et al. | 141/67 |
| 2009/0178725 | A1 | * | 7/2009 | Sonnier | 141/27 |

* cited by examiner

*Primary Examiner* — Robert J Hicks
(74) *Attorney, Agent, or Firm* — Yoshida & Associates, LLC

(57) ABSTRACT

A resin container includes a main body in which a bottom plate, a cylindrical body portion, and a ceiling plate are integrally molded, and a pipe which is inserted into the main body through an outlet port opened on the ceiling plate. The main body includes a recessed portion which is formed on the bottom plate, of which center is not located on a virtual axis line extending from a center of the outlet port in a container height direction, and a gutter-shaped groove portion which is formed on the bottom plate and reaches the recessed portion. The pipe is curved from an upper end to a lower end, and the lower end of the pipe is pressed against a boundary between an inner circumferential surface of the recessed portion at a side opposite to a side of the outlet port and a bottom surface of the recessed portion.

4 Claims, 4 Drawing Sheets

"Prior Art"

"Prior Art"

RESIN CONTAINER

CROSS REFERENCE TO RELATED APPLICATION

This application claims to the benefit of priority to Japanese Patent Application No. 2011-235555 filed on Oct. 27, 2011, of which full contents are incorporated herein by reference.

BACKGROUND OF THE INVENTION

1. Field of the Invention

The present invention relates to a resin container which accommodates liquid.

2. Description of the Related Art

When liquid such as an industrial drug is accommodated in a resin container which is integrally molded into a drum shape by blow molding so as to be stored or conveyed, a pipe is used for discharging the liquid in some cases. Conventionally, as illustrated in FIG. 5A, a pipe 150 of which one end is attached to an outlet port 125 provided on a ceiling plate 120 of a resin container 100 is lowered straightly toward a bottom plate 110 so that liquid is discharged. A method of discharging the liquid is classified broadly into a method of connecting a pump to the pipe to suck the liquid (hereinafter, referred to as "suction system") and a method of feeding the air into the container and pressurizing the liquid to push out the liquid through the pipe (hereinafter, referred to as "pressure feeding system").

Irregularities are formed on the bottom plate of the resin container which is integrally molded normally. Therefore, in the conventional resin container, there has been a problem that liquid present on a portion of a recessed surface, which is separated from a position of a lower end of the pipe due to a protruding portion, is not discharged and is left. A height of the irregularities on the bottom plate of a common resin container is not so high. However, as a capacity of the container is increased, an area of the bottom plate is increased so that a volume of residual liquid is also increased. For example, in the conventional resin container having a capacity of 200 liters, a residual liquid amount when the liquid is discharged with the suction system is as large as equal to or larger than 1.5 liters.

Further, when the liquid is discharged with the pressure feeding system, as illustrated in FIG. 5B, the bottom plate 120 expands outward with increase of a pressure in the resin container 100 so that the lower end of the pipe 150 is distanced from the bottom plate 110. In addition, the ceiling plate 120 also expands outward and the outlet port 125 is inclined. With this, the pipe 150 is inclined so that the lower end of the pipe 150 is largely distanced from the bottom plate 110 further. Therefore, in the case of the pressure feeding system, the liquid cannot be discharged at a time when the liquid level becomes lower than the lower end of the pipe 150 with the discharge of the liquid. Therefore, the residual liquid amount is large. For example, in the conventional resin container having a capacity of 200 liters, the residual liquid amount when the liquid is discharged with the pressure feeding system is as large as approximately 5 liters.

The liquid which has not been discharged from the resin container and has been left is to be discarded and is wasteful as resource. Further, there are a number of extremely expensive liquids among the industrial drugs. Therefore, a technique of reducing a residual liquid amount has been desired in terms of reduction in cost.

SUMMARY OF THE INVENTION

In view of the above circumstances, an object of the present invention is to provide a resin container which can reduce an amount of liquid which is not discharged and is left.

In order to achieve the above-described object, a resin container according to an aspect of the invention "includes a main body in which a bottom plate, a cylindrical body portion erected from an outer circumference of the bottom plate, and a ceiling plate closing an upper end of the body portion are integrally molded, and a pipe which is inserted into the main body through an outlet port opened on the ceiling plate, wherein the main body includes a recessed portion which is formed on the bottom plate in a recessed form and of which center is not located on a virtual axis line extending from a center of the outlet port in a container height direction, and a gutter-shaped groove portion which is formed on the bottom plate and reaches the recessed portion, and the pipe is curved from an upper end to a lower end, the lower end of the pipe is pressed against a boundary between an inner circumferential surface of the recessed portion at a side opposite to a side of the outlet port and a bottom surface of the recessed portion".

The center of the recessed portion is not located on the virtual axis line extending from the center of the outlet port in the container height direction. Therefore, the recessed portion is not located just under the outlet port. Further, the pipe which is sufficiently loner than a height (inner dimension) of the resin container is employed such that the pipe is curved from the outlet port toward the recessed portion.

A tensile force acts on the pipe having an extra length for a curved amount between the outlet port and the recessed portion. Therefore, the lower end of the pipe is pressed against the boundary between the inner circumferential surface of the recessed portion (hereinafter, referred to as "opposite-side inner circumferential surface" in some cases) at the side opposite to the side of the outlet port and the bottom surface of the recessed portion. Further, even when the ceiling plate and the bottom plate expand when the liquid is discharged with the pressure feeding system, the state where the lower end of the pipe is pressed against the boundary (hereinafter, referred to as "opposite-side boundary portion" in some cases) between the opposite-side inner circumferential surface and the bottom surface of the recessed portion is kept since the pipe has the extra length.

Accordingly, in the aspect of the invention with the above-mentioned configuration, even when the ceiling plate and the bottom plate expand, the lower end of the pipe stops at the opposite-side boundary portion of the recessed portion all the time. Further, at a final stage of processing of discharging the liquid, the liquid which has been reduced is collected to the recessed portion as a lower portion on the bottom plate.

In addition, the groove portion reaching the recessed portion is formed on the bottom plate. Therefore, even when the bottom plate has the irregularities and a recessed surface separated from a position of the lower end of the pipe due to the protruding portion is present, the liquid on the recessed surface is easy to flow into the recessed portion through the groove portion.

Then, almost total amount of liquid in the recessed portion is discharged through the pipe of which lower end is located at the opposite-side boundary portion. This makes it possible to discharge almost total amount of the liquid in the resin container. Therefore, the residual liquid amount can be largely reduced in comparison with the conventional technique.

In the resin container according to the aspect of the invention, it is preferable that "the recessed portion be formed on a center of the bottom plate" in the above-described configuration.

In the aspect of the invention, a configuration in which the center of the recessed portion is not located on the virtual axis line extending from the center of the outlet port in the container height direction is employed. Therefore, in the configuration in which the recessed portion is located at the center of the bottom plate, the outlet port is provided at a position which is eccentric on the ceiling plate.

The recessed portion is a lower portion on the bottom plate and is a portion on which liquid remains till the final stage when the liquid is discharged. The recessed portion is located at the center of the bottom plate so that a preferable balance of the resin container is realized and a posture thereof is stable.

In the resin container according to the aspect of the invention, it is preferable that "the main body further include an annular portion which is provided so as to project downward from the outer circumference of the bottom plate to a height lower than the bottom surface of the recessed portion" in the above-described configuration.

The resin container with the configuration is grounded at the annular portion in a state where at least the bottom plate does not expand. With this, the posture of the resin container is stable in comparison with a case where the resin container is grounded at the bottom surface of the recessed portion.

As described above, as an effect of the invention, a resin container which can reduce an amount of liquid which is not discharged and is left can be provided.

DESCRIPTION OF EXEMPLARY EMBODIMENTS

Figure 1:
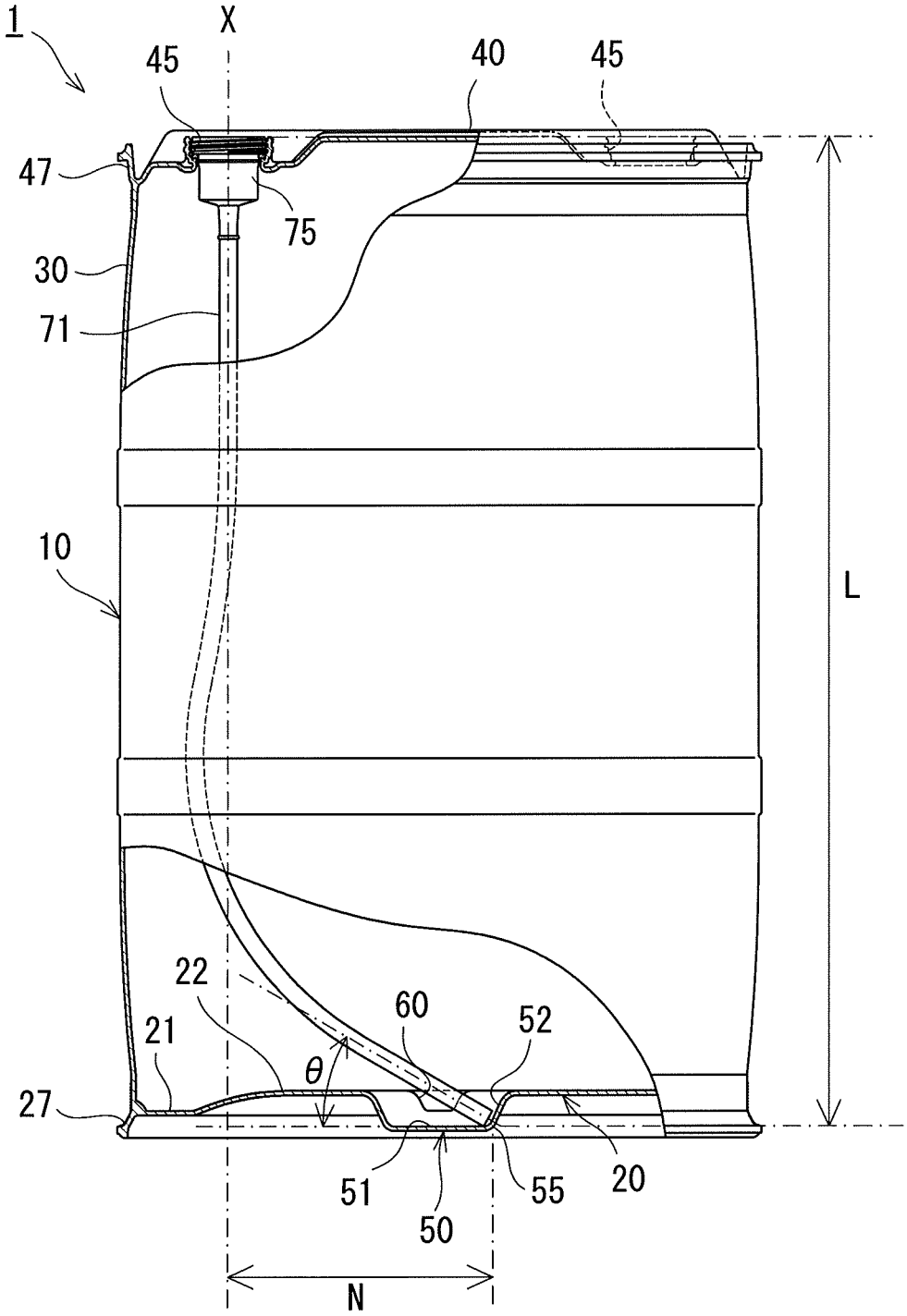
FIG. 1 is a partial cross-sectional front view illustrating a resin container according to one embodiment of the invention.

Hereinafter, a resin container 1 as one embodiment of the invention is described with reference to FIG. 1 to FIG. 4. The resin container 1 includes a main body 10 and a pipe 71. A bottom plate 20, a cylindrical body portion 30, and a ceiling plate 40 are integrally molded in the main body 10. The body portion 30 is erected from an outer circumference of the bottom plate 20. The ceiling plate 40 closes an upper end of the body portion 30. The pipe 71 is inserted into the main body 10 through an outlet port 45 opened on the ceiling plate 40. In the configuration, the main body 10 includes a recessed portion 50 and gutter-shaped groove portions 60. The recessed portion 50 is formed on the bottom plate 20 in a recessed form and a center of the recessed portion 50 is not located on a virtual axis line X extending from a center of the outlet port 45 in the container height direction. The groove portions 60 are formed on the bottom plate 20 and reach the recessed portion 50. The pipe 71 is curved from an upper end to a lower end, the lower end of the pipe 71 is pressed against a boundary (opposite-side boundary portion 55) between an inner circumferential surface 52 of the recessed portion 50 at a side opposite to a side of the outlet port 45 and a bottom surface 51 of the recessed portion 50.

As will be described more in detail, the main body 10 is integrally molded by blow molding of a thermoplastic resin such as polyethylene. The main body 10 includes a lower annular portion 27 and an upper annular portion 47 in addition to the above-described configuration. The lower annular portion 27 is provided so as to project downward from the outer circumference of the bottom plate 20. The upper annular portion 47 is provided so as to project upward from an outer circumference of the ceiling plate 40. In the main body 10 which is integrally molded by blow molding of the resin, boundaries among the bottom plate 20, the body portion 30, and the ceiling plate 40 are not necessarily clear. Therefore, the "outer circumference of the bottom plate 20" can be considered as an "outer circumference of a lower end of the body portion 30". Further, the "outer circumference of the ceiling plate 40" can be considered as an "outer circumference of an upper end of the body portion 30". It is to be noted that the "lower annular portion 27" in the embodiment corresponds to an "annular portion" in the invention.

The recessed portion 50 includes the circular bottom surface 51 and the cylindrical inner circumferential surface 52. The bottom surface 51 is provided at the center of the bottom plate 20. The inner circumferential surface 52 is erected from an outer circumference of the bottom surface 51 and a diameter of the inner circumferential surface 52 is slightly increased to the upper side. The bottom surface 51 of the recessed portion 50 corresponds to a lowermost surface of the bottom plate 20. Further, the above-described lower annular portion 27 is provided so as to project to a height lower than the bottom surface 51 of the recessed portion 50. That is to say, in a state where a pressure in the main body 10 is not increased, the bottom surface 51 of the recessed portion 50 is located at a position higher than a grounding surface and the resin container 1 is grounded at a lower end surface of the lower annular portion 27.

The bottom plate 20 includes an annular first bottom plate surface 21 along the outer circumference and a second bottom plate surface 22. The second bottom plate surface 22 is slightly swelled inward from the first bottom plate surface 21 and reaches an upper edge of the recessed portion 50. There arises the following advantage with a configuration in which the bottom plate 20 is slightly swelled from the outer circumference and reaches the recessed portion 50 as described above. That is, there arises an advantage that the lower end surface of the lower annular portion 27 can be set to a height lower than the bottom surface 51 of the recessed portion 50 even when the projecting length of the lower annular portion 27 is made shorter with the above-described configuration. That is to say, if the projecting length of the lower annular portion 27 is shorter, the lower annular portion 27 is easy to have a mechanical strength for supporting a weight of the entire resin container 1. In addition, a shape of a mold is not complicated so that the blow molding is easily performed.

Heights of bottom surfaces of the groove portions 60 are substantially equal to that of the first bottom plate surface 21 and the groove portions 60 are formed in the radial direction of the bottom plate 20 so as to connect the first bottom plate surface 21 and the recessed portion 50. In the embodiment, two groove portions 60 are formed. The two groove portions 60 are formed on the same line as a diameter of the bottom plate 20 while sandwiching the recessed portion 50 therebetween. Further, in the blow molding, a groove line having a V-shaped cross section of which both sides are slightly swelled, a so-called "parting line", is formed along a bonding portion of a pair of split molds. The groove portions 60 in the embodiment are formed in the direction intersecting with a parting line 29.

The outlet ports 45 are openings through which liquid is injected and discharged into/from the main body 10 and two outlet ports 45 are provided in the embodiment. The two outlet ports 45 are located on the same line as the diameter of the ceiling plate 40 so as to be separated from the center of the ceiling plate 40 by the same distance. Accordingly, the center of the recessed portion 50 (center of the bottom plate 20 in the embodiment) is not located on the virtual axis lines X extending from the centers of the outlet ports 45 in the container height direction. Each of the outlet ports 45 projects upward from the ceiling plate 40 in a cylindrical form and thread grooves are formed on the inner circumferential surface thereof.

The pipe 71 is attached to one of the two outlet ports 45 through a tap plug 75. Threads are formed on an outer circumferential surface of the tap plug 75. The threads are mounted on the thread grooves of the outlet port 45 so as to be fitted into the outlet port 45. An upper end of the pipe 71 is connected to the tap plug 75 but the tap plug 75 is configured so as not to rotate the pipe 71 with the rotation of itself. Further, the tap plug 75 is configured so as to communicate an external pipe (not illustrated) and the pipe 71 in the main body 10 by connecting the external pipe to the tap plug 75 in a detachable manner.

The pipe 71 is made of a resin and has flexibility. The length of the pipe 71 is set such that the pipe 71 is curved in a state where the upper end of the pipe 71 is attached to the outlet port 45 through the tap plug 75 and the lower end thereof reaches the bottom surface 51 of the recessed portion 50. Further, a tensile force acts on the pipe 71 having an extra length for the curved amount between the outlet port 45 and the recessed portion 50. Therefore, the lower end of the pipe 71 is pressed against the opposite-side boundary portion 55.

In the resin container 1 having the above-described configuration, the bottom surface 51 of the recessed portion 50 corresponds to the lowermost surface of the bottom plate 20. Therefore, the liquid which has been reduced by being discharged through the pipe 71 flows into the recessed portion 50. In the embodiment, the second bottom plate surface 22 higher than the first bottom plate surface 21 is present between the first bottom plate surface 21 and the recessed portion 50 on the bottom plate 20. However, since the groove portions 60 connecting the first bottom plate surface 21 and the recessed portion 50 are formed, the liquid flows into the recessed portion 50 through the groove portions 60 without remaining on the first bottom plate surface 21.

In addition, the parting line 29 which swells is present on the bottom plate 20. Therefore, the reduced liquid cannot get across the parting line 29 and there arises a risk that the liquid is easy to remain at both sides of the parting line 29 on the first bottom plate surface 21. However, in the embodiment, the groove portions 60 are formed in the direction intersecting with the parting line 29. With this, the liquid flows into the recessed portion 50 through the groove portions 60 from both sides separated by the parting line 29 on the first bottom plate surface 21.

Further, the lower end of the pipe 71 is located at the boundary between the bottom surface 51 and the inner circumferential surface 52 on the recessed portion 50. Therefore, almost total amount of the liquid flown into the recessed portion 50 can be discharged through the pipe 71. This makes it possible to discharge almost total amount of the liquid accommodated in the main body 10 through the pipe 71.

Further, when the liquid is discharged with the pressure feeding system, the air is fed into the main body 10 from the outside. The air can be fed through the outlet port 45 to which the pipe 71 is not attached. Alternatively, when the tap plug 75 is configured to include a communicating path for feeding the air into the main body 10 from the outside in addition to the communicating path for discharging the liquid from the main body 10 to the outside through the pipe 71, the outlet port 45 to which the pipe 71 is not attached may be sealed and the air may be fed into the main body 10 through the tap plug 75.

Figure 2:
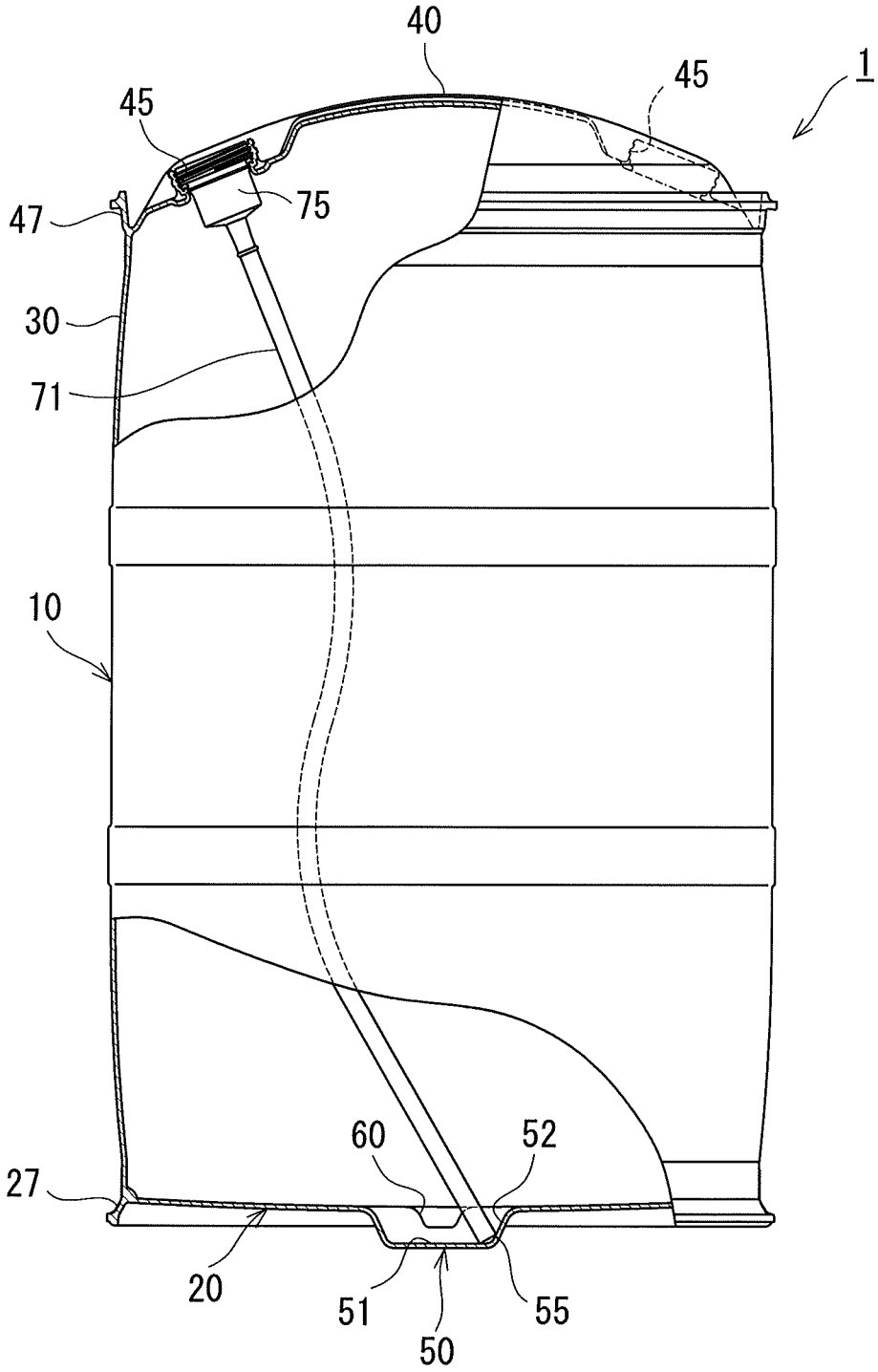
FIG. 2 is a partial cross-sectional front view illustrating the resin container in FIG. 1 when an inner pressure is increased.
Figure 3:
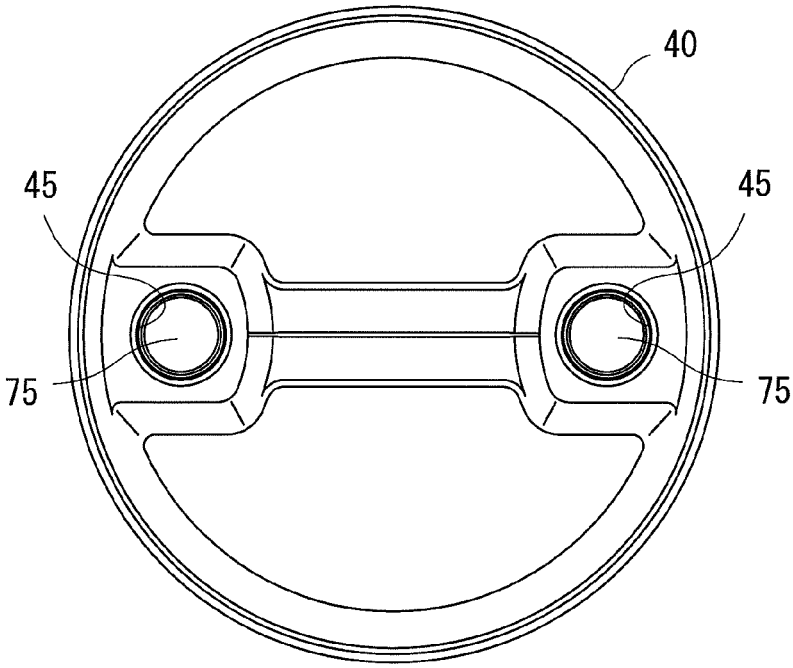
FIG. 3 is a plan view illustrating the resin container in FIG. 1.
Figure 4:
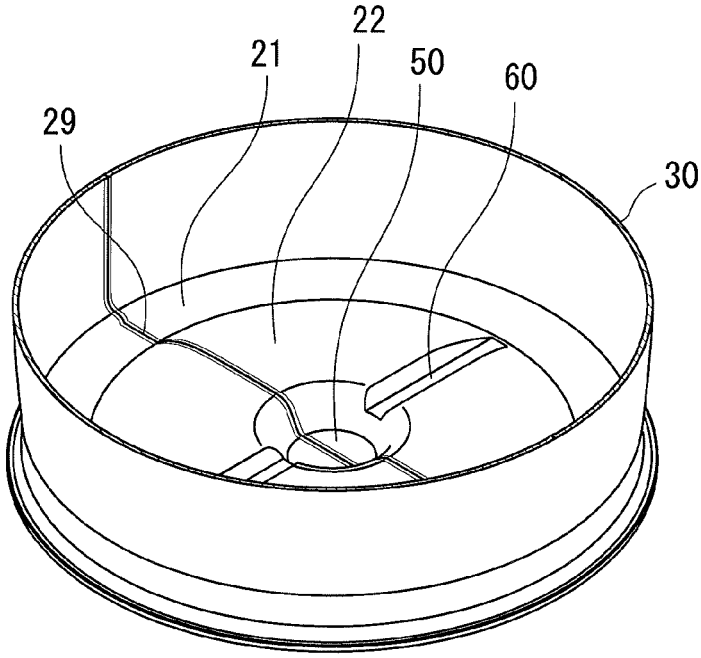
FIG. 4 is a perspective view illustrating a vicinity of a bottom plate of the resin container in FIG. 1.
Figure 5A:
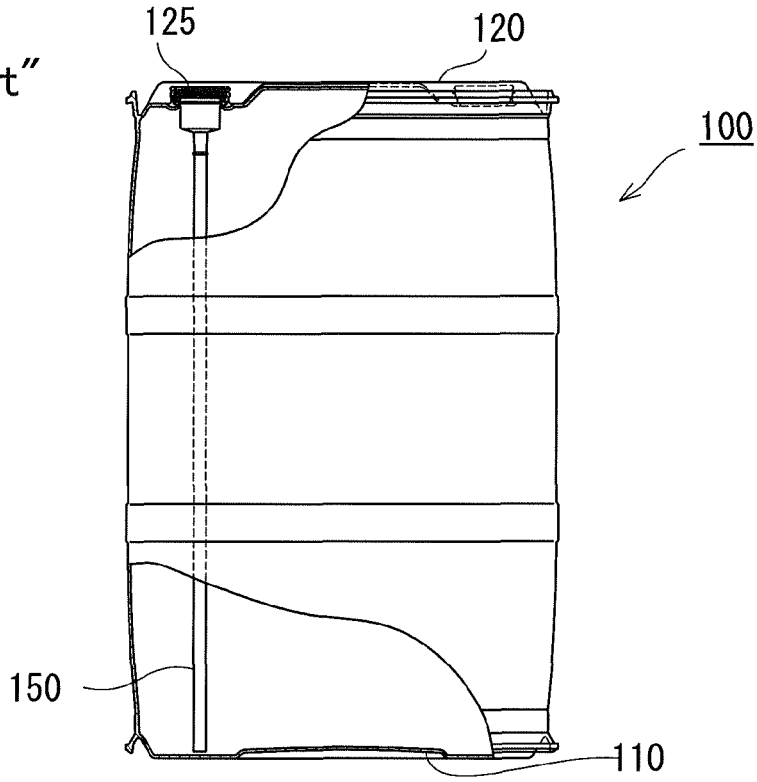
FIG. 5A is a partial cross-sectional front view for explaining discharge of liquid in a conventional resin container.
Figure 5B:
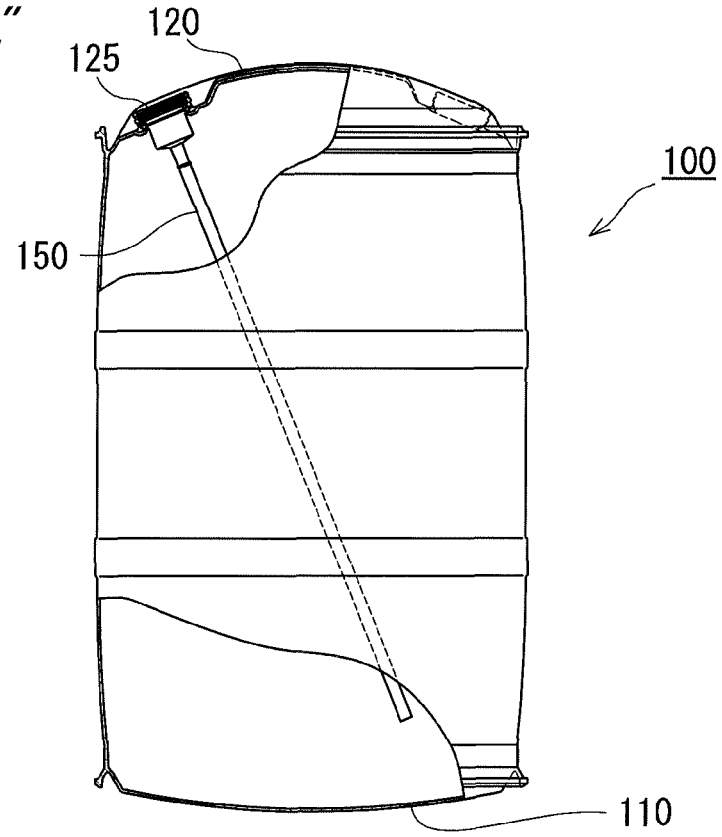
FIG. 5B is a partial cross-sectional front view for explaining discharge of the liquid in the conventional resin container when an inner pressure is increased.

If a pressure in the main body 10 is increased by feeding the air into the main body 10, the ceiling plate 40 and the bottom plate 20 expand outward, as illustrated in FIG. 2. With this, the distance between the outlet port 45 and the bottom surface 51 of the recessed portion 50 is longer. In addition, if the ceiling plate 40 expands, the outlet port 45 and the tap plug 75 fitted thereinto are inclined and the vicinity of the upper end of the pipe 71 connected to the tap plug 75 is inclined.

However, the curved pipe 71 has the extra length. Therefore, even when the ceiling plate 40 and the bottom plate 20 expand, the tensile force keeps acting on the pipe 71 between the outlet port 45 and the recessed portion 50. Therefore, the lower end of the pipe 71 stops at the opposite-side boundary portion 55 of the recessed portion 50 all the time.

A maximum height in the main body 10 (distance between the bottom surface 51 of the recessed portion 50 and the upper end of the outlet port 45 in the axial direction) is assumed to be L. Further, a distance between the center of the outlet port 45 and the opposite-side boundary portion 55 of the recessed portion 50 in the direction intersecting with the axial direction is assumed to be N. Under the assumption, the length of the pipe 71 is required to be longer than $(L^2+N^2)^{1/2}$ in a state where the ceiling plate 40 and the bottom plate 20 do not expand. In addition, in this state, it is desirable that the length of the pipe 71 is equal to or shorter than (L+N). Further, if the length of the pipe 71 is set to be longer than the distance between the opposite-side boundary portion 55 and the outlet port 45 in a state where the ceiling plate 40 and the bottom plate 20 expand, the lower end of the pipe 71 can be located at the opposite-side boundary portion 55 of the recessed portion 50 even when the liquid is discharged with the pressure feeding system. In consideration of a result of examination of change of the distance between the opposite-side boundary portion 55 and the outlet port 45 between before and after the ceiling plate 40 and the bottom plate 20 expand in resin containers having various capacities, the length of the pipe 71 is preferably set to be in a range of 103% of $(L^2+N^2)^{1/2}$ to (L+N). It is to be noted that since the size of the tap plug may be various, a length of the upper end of the outlet port to the lower end of the pipe is defined as the "length of pipe".

Further, as a result of the examination, in order to stop the lower end of the pipe 71 at the opposite-side boundary portion 55, it is effective that the length of the pipe 71 is set such that an entrance angle θ of the pipe 71 into the recessed portion 50 (angle formed by the vicinity of the lower end of the pipe 71 and the bottom surface 51 of the recessed portion 50) can be set to 35°±20°. It is considered that the above-described fact is based on balance between a component force in the direction toward the bottom surface 51 of the recessed portion 50 and a component force in the direction toward the inner circumferential surface 52 of the recessed portion 50 in the force acting on the lower end of the pipe 71 in a tensed state between the outlet port 45 and the recessed portion 50.

As described above, with the resin container 1 according to the embodiment, almost total amount of the liquid flown into the recessed portion 50 can be discharged through the pipe 71 even with the pressure feeding system with which a large amount of liquid has been left in the conventional resin container. Eventually, almost total amount of the liquid accommodated in the main body 10 can be discharged through the pipe 71.

Actually, when the liquid accommodated in the resin container having the capacity of 200 liters, which has the configuration in the embodiment, has been discharged with the pressure feeding system, the liquid which has not been discharged and has been left was equal to or less than 50 milliliters. The residual liquid is equal to or lower than one hundredth in comparison with 5 liters as the liquid residual amount when the liquid in the conventional resin container having the same capacity is discharged with the pressure feeding system, and is an extremely small amount.

As described above, the invention has been described by using a preferred embodiment. However, the invention is not limited to the above-described embodiment. Various improvements and changes in design can be made in a range without departing from a scope of the invention as will be described below.

For example, the two groove portions 60 are formed in the diameter direction of the bottom plate in the above-described embodiment. However, the invention is not limited thereto and much more groove portions can be provided around the recessed portion in a radial manner. Further, the groove portions may be formed such that the depths of the groove portions are gradually increased toward the recessed portion.

Further, the two outlet ports 45 are included in the above-described embodiment. However, the invention is not limited thereto and only one outlet port may be included. When one outlet port is included, the liquid can be also discharged with the pressure feeding system if the tap plug including the communicating path for feeding the air into the main body from the outside and the communicating path for discharging the liquid from the main body to the outside through the pipe is employed.

Further, the outlet port 45 to which the pipe 71 is attached is eccentric on the ceiling plate 40 and the recessed portion 50 is provided at the center of the bottom plate 20 in the above-described embodiment. However, the invention is not limited and it is sufficient that the center of the recessed portion is not located on the virtual axis line extending from the center of the outlet port in the container height direction. For example, a configuration in which the outlet port is eccentric on the ceiling plate and the recessed portion is eccentric in the opposite direction on the bottom plate can be employed. Alternatively, a configuration in which the outlet port is located at the center of the ceiling plate and the recessed portion is eccentric on the bottom plate can be employed.

In addition, the inner circumferential surface 52 of the recessed portion 50 has a cylindrical shape of which diameter is slightly increased toward the upper side in the above-described embodiment. However, the invention is not limited thereto and the inner circumferential surface 52 may have a vertical cylindrical shape of which diameter is the same as that of the outer circumferential circle of the bottom surface of the recessed portion. When the inner circumferential surface has the cylindrical shape of which diameter is increased toward the upper side, there is an advantage that moldability of the recessed portion is excellent. On the other hand, when the inner circumferential surface has the vertical cylindrical shape, there is an advantage that a stopper-like effect of holding a pressed tip of the pipe on the opposite-side boundary portion is enhanced.

In addition, the recessed portion 50 has a circular shape when seen from the above in the above-described embodiment. However, the shape of the recessed portion 50 is not particularly limited as long as the lower end of the pipe can be made to abut against the boundary between the bottom surface and the inner circumferential surface of the recessed portion 50. For example, the recessed portion 50 may be a recessed portion including a bottom surface having an elliptical shape or a polygonal shape and an inner circumferential surface erected from the outer circumference of the bottom surface. It is to be noted that the recessed portion is formed by the blow molding of the resin as described above. Therefore, the expression "boundary between the bottom surface and the inner circumferential surface" of the recessed portion indicates a concept encompassing a case where a clear boundary line is not necessarily expressed.

What is claimed is:

1. A resin container comprising:

a main body in which a bottom plate, a cylindrical body portion erected from an outer circumference of the bottom plate, and a ceiling plate closing an upper end of the body portion are integrally molded, and a pipe which is inserted into the main body through an outlet port opened on the ceiling plate, wherein the main body includes:

a recessed portion which is formed on the bottom plate in a recessed form and of which center is not located on a virtual axis line extending from a center of the outlet port in a container height direction, and a gutter-shaped groove portion which is formed on the bottom plate and reaches the recessed portion, and the pipe is curved from an upper end to a lower end, and the lower end of the pipe is pressed against a boundary between an inner circumferential surface of the recessed portion at a side opposite to a side of the outlet port and a bottom surface of the recessed portion.

2. The resin container according to claim 1, wherein the recessed portion is formed on a center of the bottom plate.

3. The resin container according to claim 1, wherein the main body further includes an annular portion which is provided so as to project downward from the outer circumference of the bottom plate to a height lower than the bottom surface of the recessed portion.

4. The resin container according to claim 2, wherein the main body further includes an annular portion which is provided so as to project downward from the outer circumference of the bottom plate to a height lower than the bottom surface of the recessed portion.

* * * * *